United States Patent [19]

Ruemer, Jr.

[11] 4,402,421

[45] Sep. 6, 1983

[54] CONTAINER CLOSURE HAVING EASY-OPENING MEANS

[75] Inventor: John Ruemer, Jr., Baltimore, Md.

[73] Assignee: Crown Cork & Seal Company, Inc., Philadelphia, Pa.

[21] Appl. No.: 384,239

[22] Filed: Jun. 2, 1982

Related U.S. Application Data

[63] Continuation-in-part of Ser. No. 325,462, Nov. 27, 1981.

[51] Int. Cl.[3] ..... B65D 17/34

[52] U.S. Cl. ..... 220/269

[58] Field of Search ..... 220/269–273

[56] References Cited

U.S. PATENT DOCUMENTS

| | | | |
|---|---|---|---|
| 3,717,279 | 1/1972 | Patarini et al. | 220/269 |
| 3,967,752 | 7/1976 | Cudzik | 220/269 |
| 4,024,981 | 4/1977 | Brown | 220/269 |
| 4,210,257 | 7/1980 | Radtke | 220/269 |
| 4,320,850 | 3/1982 | Drolen, Jr. | 220/269 |

*Primary Examiner*—George T. Hall

*Attorney, Agent, or Firm*—Woodcock, Washburn, Kurtz, Mackiewicz & Norris

[57] ABSTRACT

An improved easy opening container end is disclosed of the type wherein an opening tab is attached to a wall of a can end closure at a fulcrum adjacent a primary score line. The primary score line circumscribes a pour opening panel except at a hinge area. The forward portion of the opening tab is adapted to depress the pour opening panel into the container to expose a pour opening when the opening tab is pivoted about the fulcrum. The opening tab is attached to the wall by means of a rivet. One secondary score line intersects with the primary score line and projects away from the pour opening panel on one side of the rivet and another secondary score line, also intersects with the primary score line, and projects away from the pour opening panel on the other side of the rivet. In this manner, after the primary score line is severed and the pour opening panel is depressed, the opening tab may be retracted from the vicinity of the pour opening panel by severing the secondary score line so as to provide easy removal of the contents of the container and to expose an underportion of the wall for the reading of promotional indicia. In another embodiment, a region of the wall contiguous with the pour opening panel and further defined by a secondary score line may be provided such that after depression of the pour opening panel, the pour opening panel, and the region attached thereto by means of a hinge area may be severed from the container end along with the opening tab.

12 Claims, 7 Drawing Figures

CONTAINER CLOSURE HAVING EASY-OPENING MEANS

RELATED APPLICATIONS

This application is a continuation-in-part to copending application Ser. No. 325,462 filed Nov. 27, 1981 which is assigned to the assignee of the present application.

BACKGROUND OF THE INVENTION

The present invention relates in general, to a container closure and, in particular, relates to a container closure having an opening tab adapted to be retained thereto after the closure is opened.

In recent years, containers of the type generally used for beer and beverages have employed closures, or can ends, having easy opening tabs. In the first generation of such closures, the pour opening panel and opening tab were of the type which was severable from the container closure at the time the container was opened. Such removable easy opening tabs presented a problem from the standpoint of litter.

In the second generation easy opening tabs the tab is permanently retained on the can end. In such an end, the pour opening panel is defined by a score line. Situated adjacent the score line is an opening tab secured to the closure by means of a rivet. The opening tab of this type of closure is adapted to pivot about a fulcrum and to depress the pour opening panel into the container with the opening tab thereafter being retained to the container closure. One such prior art retained tab container closure is set forth and described in U.S. Pat. No. 3,967,752-Cudzik.

One difficulty encountered in container closures of the type disclosed in the aforementioned Cudzik patent and elsewhere, is that after the opening tab is utilized to sever the pour opening panel from the remainder of the closure at the score line defining the pour opening panel, the retained opening tab remains situated in the vicinity of the pour opening. Since the opening tab and pour opening panel are in the vicinity of the pour opening, difficulties are encountered in pouring the contents of the container through the pour opening. Further, difficulties are encountered when the contents are consumed directly from the container. In this circumstance, the opening tab tends to present an obstacle to the user.

It would be desirable to provide an improved container closure which does not suffer from the aforementioned disadvantages, while retaining the benefits achieved utilizing an opening tab which is retained to the end closure after opening.

Still another problem associated with retained tab type container closures of the type disclosed in the aforementioned Cudzik patent is that these do not lend themselves to various promotional methods now commonly employed. In one promotional method now employed with removeable easy opening tabs, a message or indicia is placed on the inside surface of the tab. The buyer, or consumer, of a particular container removes such easy opening tabs to read the indicia which may indicate a promotional message or the like. With easy opening tabs of the retained type, however, it is impossible to read promotional messages on the inside surface thereof since, after opening, the pour opening panel is inside the container.

It would be desirable to provide an improved container closure of the retained tab type which lends itself to the utilization of promotional messages.

SUMMARY OF THE INVENTION

The present invention in a first embodiment solves the aforementioned difficulties by the provision of an end closure of the type having a wall with a pour opening panel defined by a primary score line. The primary score line circumscribes the panel almost in its entirety except at the region of a hinge. An opening tab is attached to the wall adjacent the panel and a rivet type fastening means is utilized to permanently secure the tab to the wall. However, in accordance with this embodiment of the present invention, a pair of secondary score lines are formed in the wall. The secondary score lines are contiguous with the primary score line and project away from it on opposite sides of the aforementioned rivet. The secondary score lines thus define a tab retraction means such that after the pour opening panel is depressed by means of the opening tab, the tab may be retracted from the vicinity of the then exposed pour opening. Promotional indicia may be displayed on the underside of the retracted region of the wall which indicia are viewable after retraction.

In accordance with the first embodiment of the present invention, the aforementioned secondary score lines are of lesser depth than the primary score lines, thus ensuring that the pour opening panel is depressed prior to the time that the opening tab is retracted from the vicinity thereof. Moreover, the secondary score lines are flared in the vicinity of the rivet such that upon initial depression of the pour opening panel venting may be accomplished without rupture of the secondary score lines by the pressure of the container contents. Also, in accordance with this first embodiment of the present invention the opening tab is provided with an aperture suitable for finger engagement thereby permitting easy retraction of the tab from the vicinity of the pour opening upon severing the secondary score lines.

In a second embodiment of the present invention, an end closure is provided with a means for selectively removing the pour opening panel, the opening tab and the fastening means from the closure after the same has been opened. In this second embodiment, promotional indicia either on the outside surface of the pour opening panel or on the bottom surface of the opening tab are obscured when the container is closed but are visable when the container is opened. Such indicia may indicate the award of a prize or the like upon presentation to or redemption by a distributor or merchant. The aforementioned means for removal of the pour opening panel, tab and fastening means thus permits such redemption. Thus, this embodiment of the present invention permits removal of the part of the closure containing promotional indicia when a prize is won. However, when no prize is won the pour opening panel and opening tab remain attached to the closure to prevent litter. The means for removal includes a region of the wall contiguous with the pour opening panel and with the hinge area and is further defined by a secondary score line. The fastening means is situated within this region. The secondary score line preferably intersects the primary score line such that severance of the secondary score line permits the complete removal of the pour opening panel and the opening tab (attached thereto by the hinge area) from the end closure for redemption. If no prize is won or promotion offered, the opening tab may remain attached to the end closure so as to avoid litter.

BRIEF DESCRIPTION OF THE DRAWINGS

The present invention will be more fully understood by reference to the accompanying drawing in which.

DETAILED DESCRIPTION OF THE PREFERRED EMBODIMENT

Figure 1:
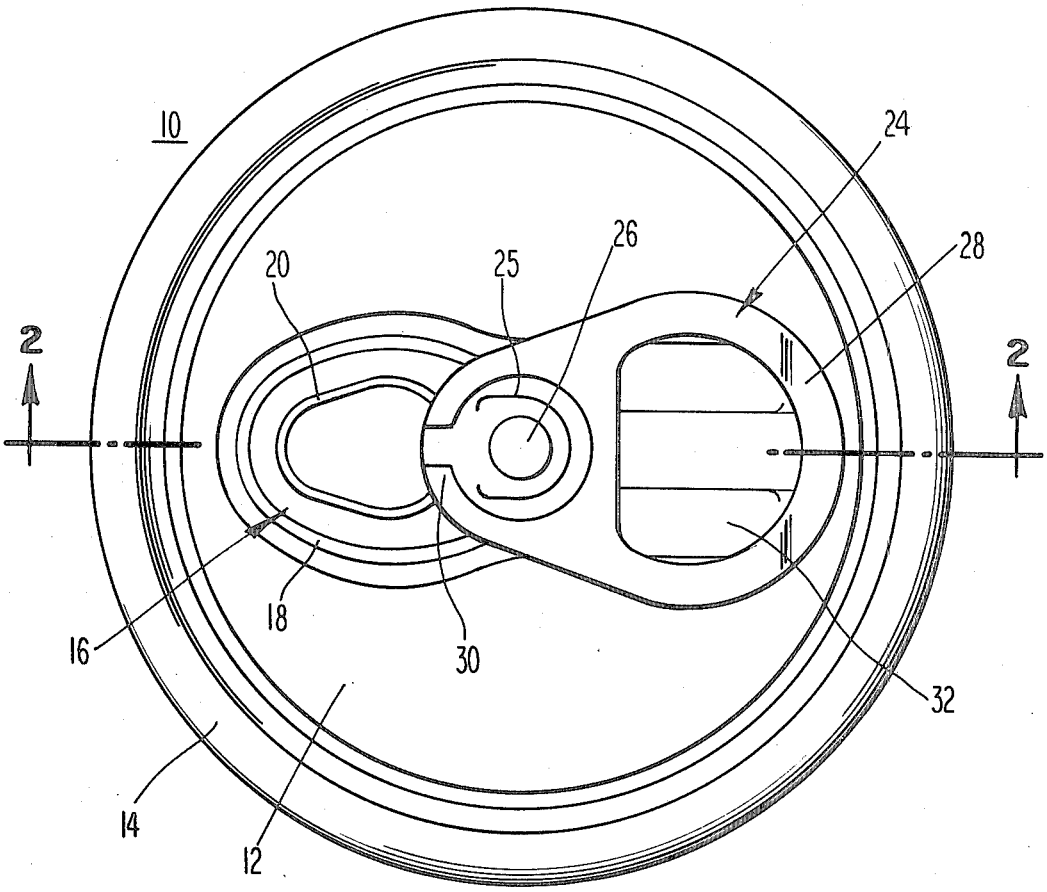
FIG. 1 is a top view of a first embodiment of the end closure of the present invention in the closed position.
Figure 2:
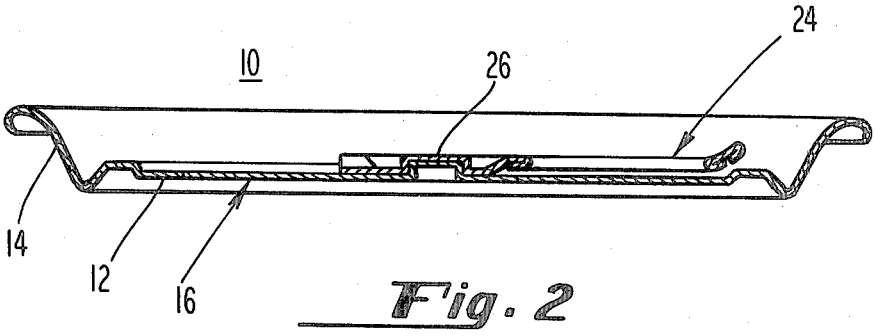
FIG. 2 is a cross-sectional view of the end closure of FIG. 1 taken in the direction of lines 2—2.

Referring now to FIG. 1, a first embodiment of an end closure of the present invention is shown generally at 10. The end closure 10 is adapted to be situated at the top of a container (not shown) of the type generally used for containing beer and/or beverages. The end closure 10 comprises a wall 12 having a peripheral edge 14. The peripheral edge 14 of the end closure 10 is suitable for fastening to the aforementioned container by means of a conventional flanging operation. The end closure 10 includes a pour opening panel 16 through which the contents of the container are dispensed when the end closure is opened. The pour opening panel 16 is defined by means of a primary score line 18. More centrally located than the primary score line 18 on the surface of the pour opening panel 16 is a reinforcing ridge 20.

Figure 3:
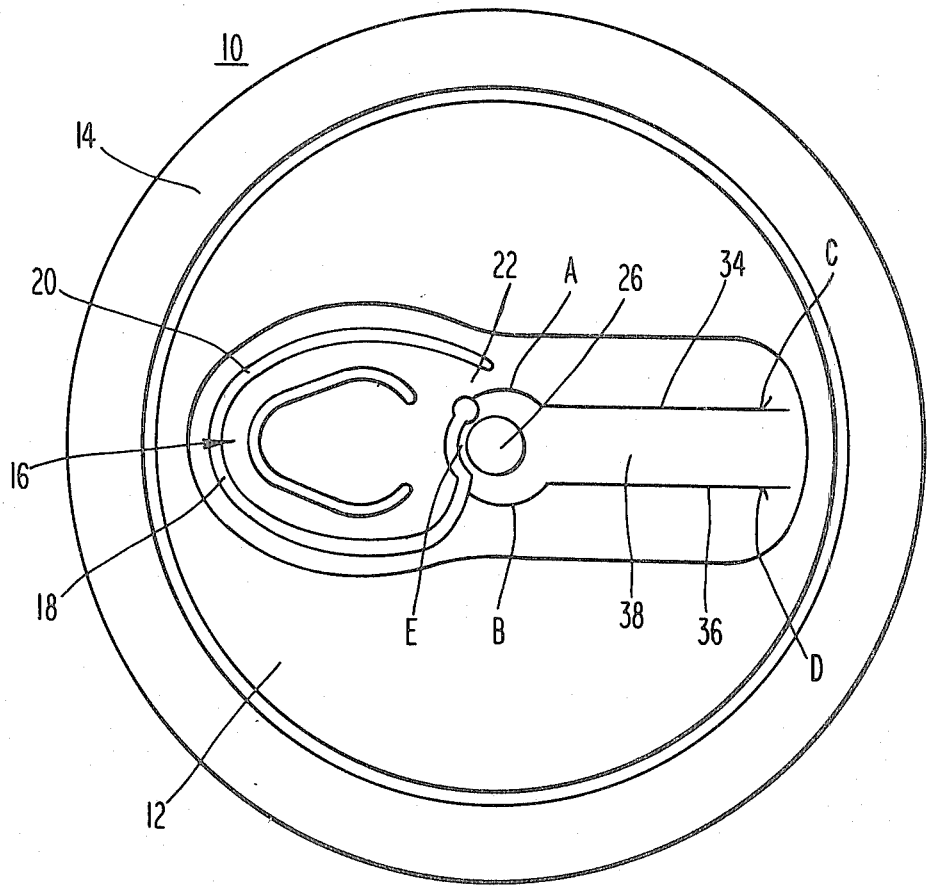
FIG. 3 is a top view of the end closure of FIG. 1, also in the closed position, but with the opening tab thereof removed for the sake of clarity.

As may best seen in FIG. 3, neither the primary score line 18 nor the reinforcing ridge 20 completely define an enclosed region. Thus, the reinforcing ridge 20 is preferably of a U-shape as shown. The primary score line 18, however, completely circumscribes the pour opening panel except at a small hinge region 22.

Referring again to FIG. 1, the closure 10 further comprises an opening tab 24. The opening tab 24 is attached to the wall 12 by a fastening means which preferably comprises a rivet 26 extending through a portion of the opening tab 24. The rivet 26 is preferably a cylindrical hollow rivet defined by the wall 12 and being an integral part thereof. The opening tab 24 includes a handle portion 28 and a forward portion 30. The opening tab 24 is adapted to pivot about a fulcrum at or near the rivet 26 such that when the handle portion 28 is lifted, the forward portion 30 is depressed, thereby depressing the pour opening panel 16 into the interior of the container about the hinge region 22 (FIG. 3). To facilitate the lifting of the handle portion 28 with the fingers, the wall 12 preferably includes a central aperture 32 suitable for finger engagement. In addition the opening tab also includes a score line 25 such that the opening tab 24 may pivot about the fulcrum without separation from the wall 12 at the rivet 26.

Referring again to FIG. 3, and in accordance with an important aspect of the present invention, the wall 12 of the end closure 10 of the present invention includes a pair of secondary score lines 34 and 36. The secondary score line 34 intersects with the primary score line 18 at a first point. The secondary score line 34 projects away from the pour opening panel 16 toward the peripheral edge 14 and is adjacent to the fulcrum about which the opening tab 24 pivots. The secondary score line is, thus, adjacent to the rivet 26. The other secondary score line 36 intersects with the primary score line 18 at a second point. The secondary score line 36, like the secondary score line 34, also projects away from the pour opening panel 16 in a direction toward the peripheral edge 14 but on the opposite side of the rivet 26. The region 38, which is intermediate to the secondary score lines 34 and 36 thus provides a means for retracting the opening tab 16 from the vicinity of the pore opening after the pore opening panel 16 is depressed.

It has been found desirable to flare the secondary score lines 34 and 36 such that the distance between them in the vicinity of the rivet 26 (e.g., the distance between points A and B) exceeds the distance between them at points radially disposed from the rivet (e.g., the distance between points C and D in FIG. 3). It has been found that by flaring the distance between the secondary score lines 34 and 36 in the region of the rivet 26, improved venting of the container may be achieved. Because the distance between points A and B of FIG. 3 is increased by flaring, initial depression of the opening tab 24 vents the container at point E and prevents unwanted rupture or severence of the secondary score lines 34 and 36 upon initial opening of the container caused by excessive pressure of the liquid contents.

Figure 4:
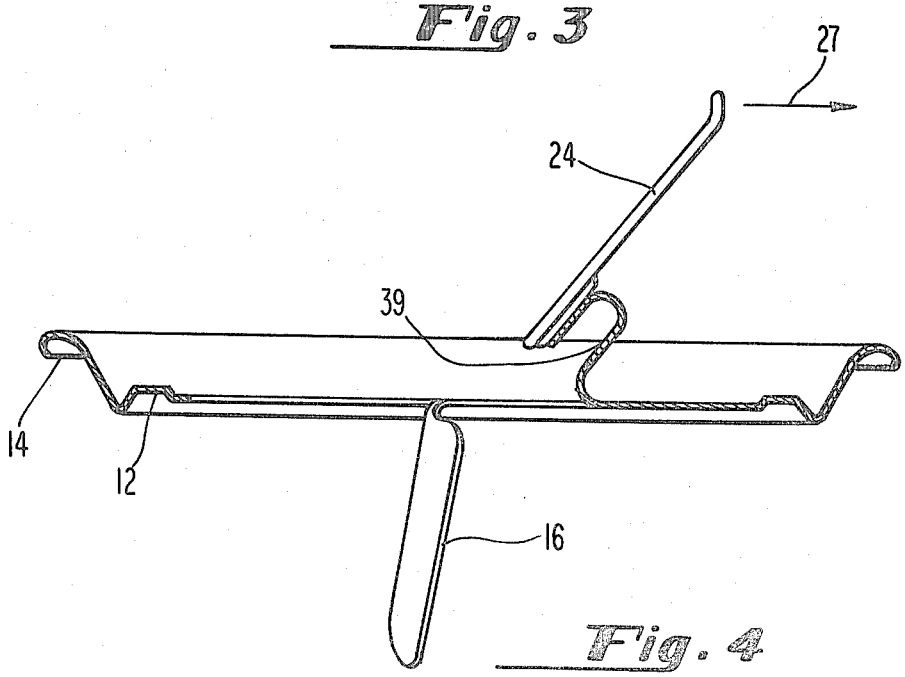
FIG. 4 is a cross-sectional view of the end closure of FIG. 1 similar to that shown in FIG. 2 but with the pour opening panel in an open position and with the opening tab partially retracted from the vicinity of the pour opening.

As may best be seen in FIG. 4, after the pour opening panel 16 is depressed, the opening tab 24 may be pulled back and away from the pour opening in the direction of arrow 27 thereby permitting unobstructed egress of the contents of the container. Moreover, the underside 39 of the means 38 for retracting the opening tab 24 may be embossed or printed with promotional indicia which may then be viewed by the consumer after the container is opened.

Figure 5:
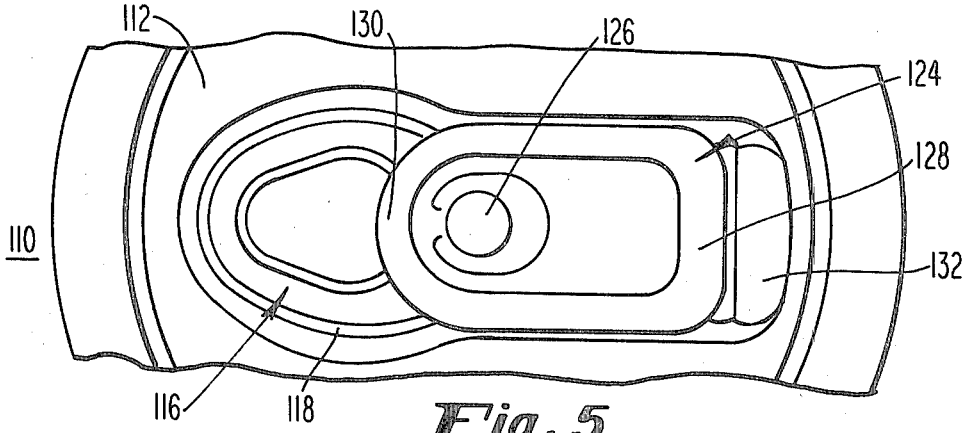
FIG. 5 is a top view of a second embodiment of the end closure of the present invention in a closed position.

Referring now to FIG. 5, a second embodiment of the end closure of the present invention is shown generally at 110. The end closure 110 includes a wall 112 with a peripheral edge 114 suitable for fastening to a container (not shown) by a conventional flanging operation. The end closure 110 includes a pour opening panel 116 which is defined by means of a primary score line 118.

Figure 6:
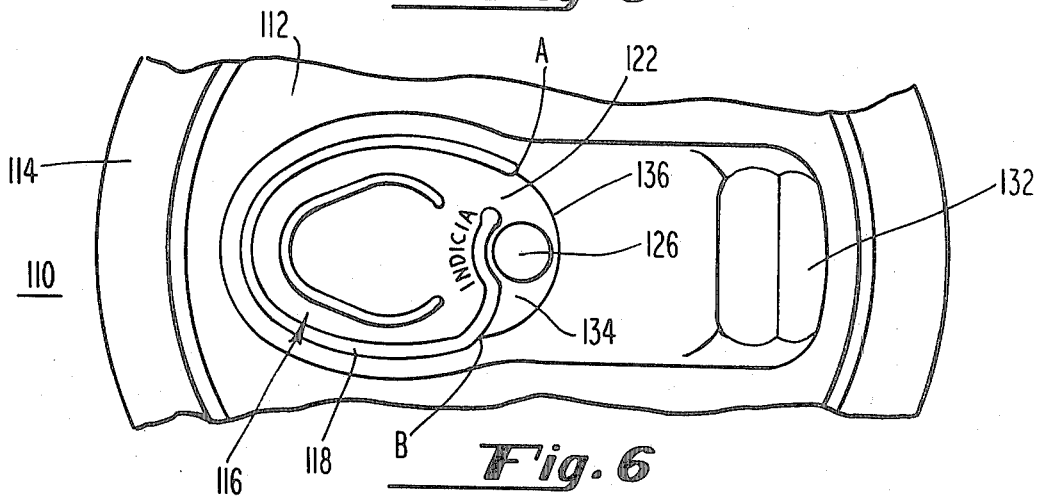
FIG. 6 is a top view of the end closure of FIG. 5, also in the closed position, but with the opening tab thereof removed for the sake of clarity.

As may best be seen from FIG. 6, the primary score line 118 completely circumscribes the pour opening panel 116 except at a small hinge region 122. Promotional indicia may be located on the pour opening panel at the general location shown in FIG. 6 such that these indicia are obscured by the forward portion 130 of the opening tab 124 when the container is closed. Alternatively, promotional indicia may be situated on the inside surface of the pour opening panel 116.

Referring again to FIG. 5, the closure 110 further comprises an opening tab 124. The opening tab 124 is attached to the wall 112 by a fastening means which preferably comprises a rivet 126 extending through a portion of the opening tab 124. The opening tab 124 includes a handle portion 128 and a forward portion 130. The opening tab 124 is adapted to pivot about a fulcrum at or near the rivet 126 such as the handle portion 128 is lifted, the forward portion 130 is depressed, thereby depressing the pour opening panel 116 into the interior of the container about the hinge region 122. To facilitate the lifting of the handle portion 128 with the fingers, the wall 112 preferably includes a depression 132 to facilitate the insertion of the finger or an object under the opening tab 124.

Referring again to FIG. 6, and in accordance with an important aspect of this embodiment of the present invention, the wall 112 of the end closure of the present invention also includes a means for selectively removing the pour opening panel 116, the opening tab 124 and the rivet 126 from the end closure 110 after the closure has been opened. This means includes a region 134 of the wall 110 which is contiguous with the pour opening panel 116 at the hinge area 122 and which is further defined by a secondary score line 136 preferably intersecting with the primary score line at two points. The first point, shown at A, is on one side of the hinge area 122 and the second point, shown at B, is on the other side of the hinge area 122. While as shown in FIG. 6, the secondary score line 136 intersects the primary score line 118 at points A and B, it may be sufficient, although it is not preferred, that the secondary score line terminate proximate to either one or both of these points without actually intersecting with the primary score line 118.

Further, it is also preferred that the secondary score line 136 be of lesser depth in the wall 112 than the primary score line 118 so as to insure that initial application of force to the opening tab 124 will cause breakage of the primary score line before the secondary score line is severed.

Figure 7:
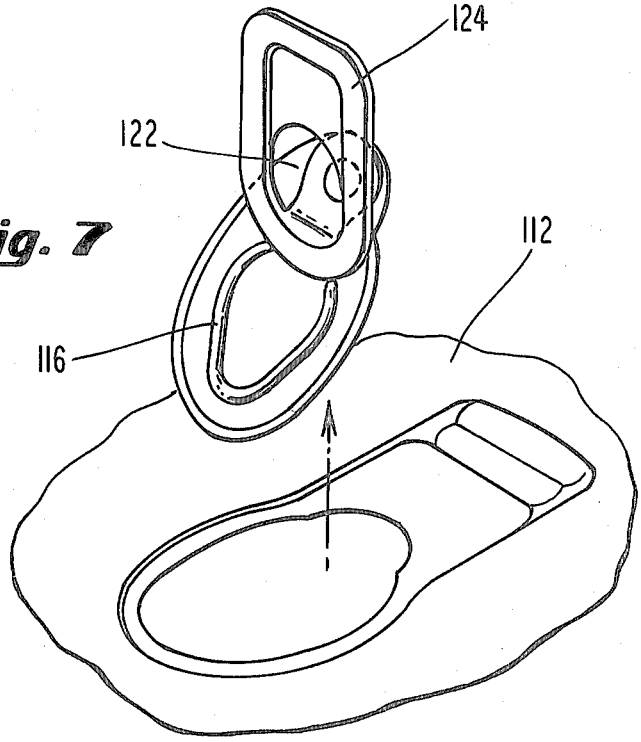
FIG. 7 is a perspective view of the pour opening panel, fastening means and opening tab completely removed from the end closure of FIG. 5 after the same has been opened.

Referring now to FIG. 7, the aforementioned means for selectively removing the pour opening panel 116, opening tab 124, and fastening means 126 from the wall 112 will be seen after having been so removed by severing the secondary score line 136. Promotional indicia which has either been located on the outside surface of the tab 116 in the location shown in FIG. 6, or alternatively on the bottom surface of the tab 124 may be viewed by the consumer after the container is opened. If redemption is desired the entire assembly as shown in FIG. 7 may be separated from the wall 112 of the closure 110 and presented to a merchant for redemption. If alternatively, promotional indicia are situated on the undersurface of the pour opening panel 116, such indicia are not viewable until the entire assembly of FIG. 7 has been separated from the wall 112.

While the present exemplary embodiments of this invention have been illustrated and described, it will be recognized that this invention may be otherwise variously embodied and practiced within the scope of the following claims.

What is claimed is:

1. An end closure of the type having a wall with a peripheral edge comprising:

a pour opening panel in said wall, said panel being defined by a primary score line, said primary score line circumscribing said pour opening panel except at a hinge area;

an opening tab attached to said wall at a fulcrum adjacent said primary score line, said opening tab having a handle portion and a forward portion, said forward portion being adapted to depress said pour opening panel to expose a pour opening when said opening tab is pivoted about said fulcrum;

a fastening means at said fulcrum for securing said opening tab to said wall;

one secondary score line intersecting the said primary score line at a first point and projecting away from said pour opening panel to a second point, said one secondary score line being adjacent to said fulcrum on one side of said fastening means;

another secondary score line intersecting said primary score line at a third point and projecting away from said pour opening panel to a fourth point, said another secondary score line being adjacent said fulcrum on the other side of said fastening means, said one and said another secondary score lines defining a means for retracting said opening tab from said pour opening after said pour opening panel has been depressed, the distance between said one and said another secondary score line being greater in the region of said fastening means than the distance therebetween at said third and said fourth points.

2. The end closure of claim 1 wherein said secondary score lines are of lesser depth in said wall than said primary score line.

3. The end closure of claim 1 wherein said opening tab includes an aperture therein for finger engagement.

4. An end closure of the type having a wall with a peripheral edge comprising:

a pour opening panel in said wall, said panel being defined by a primary score line, said primary score line circumscribing said pour opening panel except at a hinge area;

an opening tab attached to said wall at a fulcrum adjacent said primary score line, said opening tab having a handle portion and a forward portion, said forward portion being adapted to depress said pour opening panel at said hinge area to expose a pour opening when said opening tab is pivoted about said fulcrum;

a fastening means at said fulcrum for securing said opening tab to said wall both before and after said pour opening is exposed; and a means for selectively removing said pour opening panel, said opening tab and said fastening means from said wall.

5. The end closure of claim 4 wherein said pour opening panel further comprises:

promotional indicia situated under the forward portion of said opening tab, said indicia being obscured by said portion when said pore opening is unexposed, but being viewable when said pore opening is exposed.

6. The end closure of claim 4 wherein said opening tab further comprises:

promotional indicia situated under the forward portion of said opening tab, said indicia being obscured by said portion when said pore opening is unexposed, but being viewable when said pore opening is exposed.

7. The end closure of claim 4 wherein said means for selectively removing comprises:

a region of said wall contiguous with said pour opening panel and further defined by a secondary score line, said secondary score line intersecting said primary score line at a first point on one side of said hinge area, said fastening means being situated within said region.

8. The end closure of claim 4 wherein said secondary score line additionally intersects with the said primary score line at a second point on the other side of said hinge area.

9. The end closure of claim 4 wherein said means for selectively removing comprises:

a region of said wall contiguous with said pour opening panel and further defined by a secondary score line, said secondary score line terminating at a first point proximate to said primary score line on one side of said hinge area and at a second point proximate to said secondary score line on the other side of said hinge area, said fastening means being situated within said region.

10. The end closure of claim 4 wherein said secondary score line is of lesser depth in said wall than said primary score line.

11. The end closure of claim 4 wherein said fastening means comprises a rivet extending through a portion of said opening tab.

12. The end closure of claim 11 wherein said rivet comprises a cylindrical hollow rivet defined by said wall as an integral part thereof.

* * * * *